US006883769B2

(12) United States Patent
Shamoon

(10) Patent No.: US 6,883,769 B2
(45) Date of Patent: Apr. 26, 2005

(54) CLIPBOARD

(76) Inventor: Ellis N. Shamoon, 2833 Park Bridge Ct., Dallas, TX (US) 75219

( * ) Notice: Subject to any disclaimer, the term of this patent is extended or adjusted under 35 U.S.C. 154(b) by 0 days.

(21) Appl. No.: 10/604,322

(22) Filed: Jul. 10, 2003

(65) Prior Publication Data

US 2005/0006551 A1 Jan. 13, 2005

(51) Int. Cl.[7] ..... A47B 97/04

(52) U.S. Cl. ..... 248/447; 248/451; 248/452; 248/453; 24/67 R; 24/67.3; 281/45

(58) Field of Search ..... 248/447, 447.2, 248/452, 451, 453, 222.11, 222.12; 281/45; 24/67 R, 67.3, 67.7; 108/43

(56) References Cited

U.S. PATENT DOCUMENTS 2,943,372 A * 7/1960 Fleming ..... 24/67.7
3,297,862 A * 1/1967 Levy et al. ..... 362/99
3,711,899 A * 1/1973 Shelton et al. ..... 24/67.7
4,628,572 A * 12/1986 Chang ..... 24/67.11
5,226,215 A * 7/1993 Evenson ..... 24/67.5
5,312,082 A * 5/1994 Chang ..... 248/452
5,413,382 A * 5/1995 Cornell ..... 281/45
5,620,162 A * 4/1997 Beckwith et al. ..... 248/442.2
6,213,517 B1 * 4/2001 Goluszka et al. ..... 281/45
6,386,589 B1 * 5/2002 Yuh ..... 281/45
6,405,910 B1 * 6/2002 Infanti et al. ..... 224/668

FOREIGN PATENT DOCUMENTS

DE 4018556 C1 * 9/1991

* cited by examiner

*Primary Examiner*—Kimberly T. Wood
(74) *Attorney, Agent, or Firm*—Daniel V. Thompson

(57) ABSTRACT

A clipboard has a clip with upper and lower parts joined by a hinge. The lower part includes a locking wall and spaced-apart hold-down edges. The board has at least one upstanding lock element engaged with the locking wall on the lower part of the clip. The board includes grips engaged with the hold-down edges of the lower part of the clip.

6 Claims, 3 Drawing Sheets

CLIPBOARD

BACKGROUND OF INVENTION

This invention relates to clipboards having a writing board with a spring clip for holding papers and the like, and, more particularly, to a clipboard having a simplified construction using a one-piece clip.

It is, of course, well known that clipboards are extremely useful in a variety of business, industrial and institutional applications in which a portable writing board is desired. Conventional clipboards have a metal clip formed of two main parts: a lower part riveted to a board and hingedly connected to an upper part, with a spring urging the upper part into contact with the board to hold papers. The upper part is connected to the lower part at a hinge location, the hinge location being between a wide, paper-holding edge and a tab for opening the clip against the urging of the spring.

SUMMARY OF INVENTION

A clipboard has a clip with upper and lower parts joined by a hinge. The lower part includes a locking wall and spaced-apart hold-down edges. The board has at least one upstanding lock element engaged with the locking wall on the lower part of the clip. The board includes grips engaged with the hold-down edges of the lower part of the clip.

BRIEF DESCRIPTION OF DRAWINGS

A more complete understanding of the invention and its advantages will be apparent from the Detailed Description taken in conjunction with the accompanying Drawings, in which.

DETAILED DESCRIPTION

Figure 1:
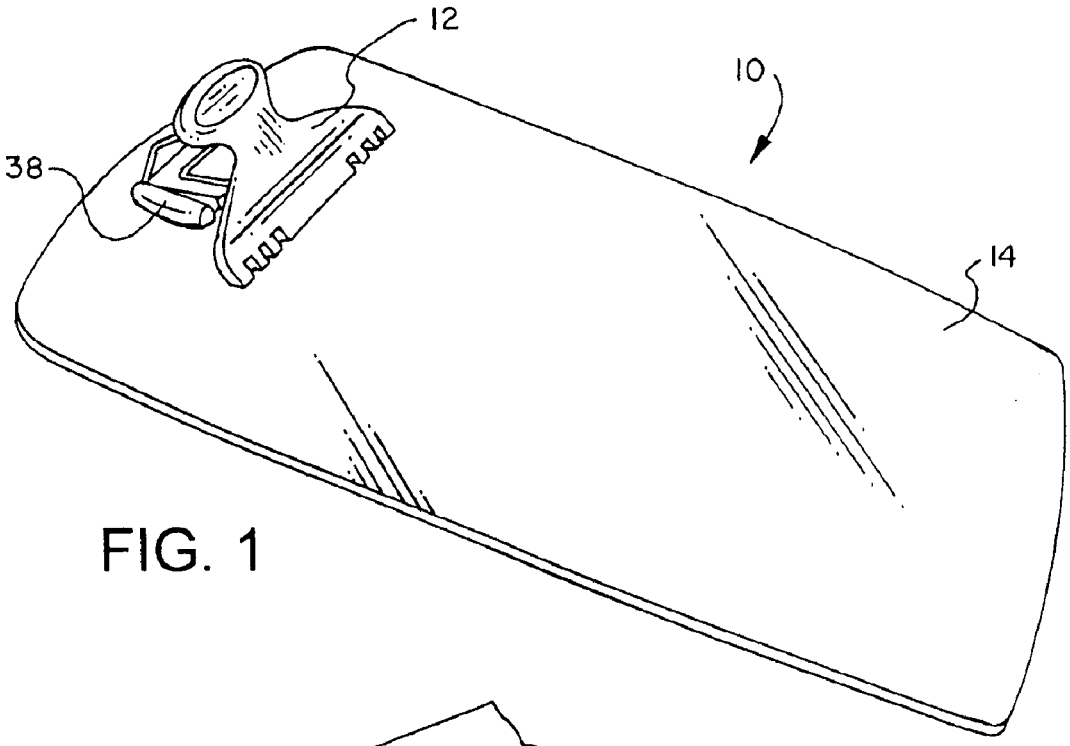
FIG. 1 is a perspective view of the clipboard of the present invention.
Figure 2:
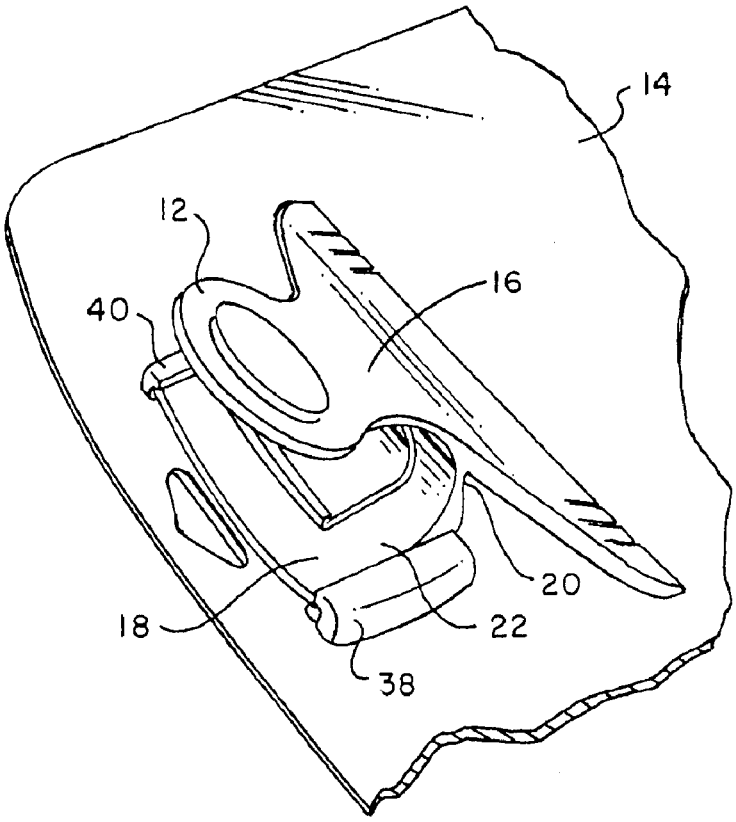
FIG. 2 is a perspective view of the clip mounted to the board.
Figure 3:
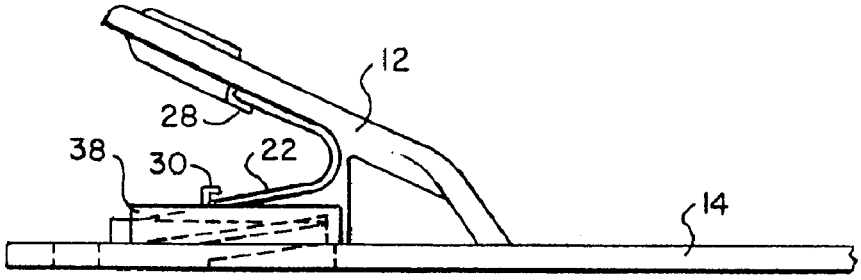
FIG. 3 is a side view of the clip mounted to the board.
Figure 4:
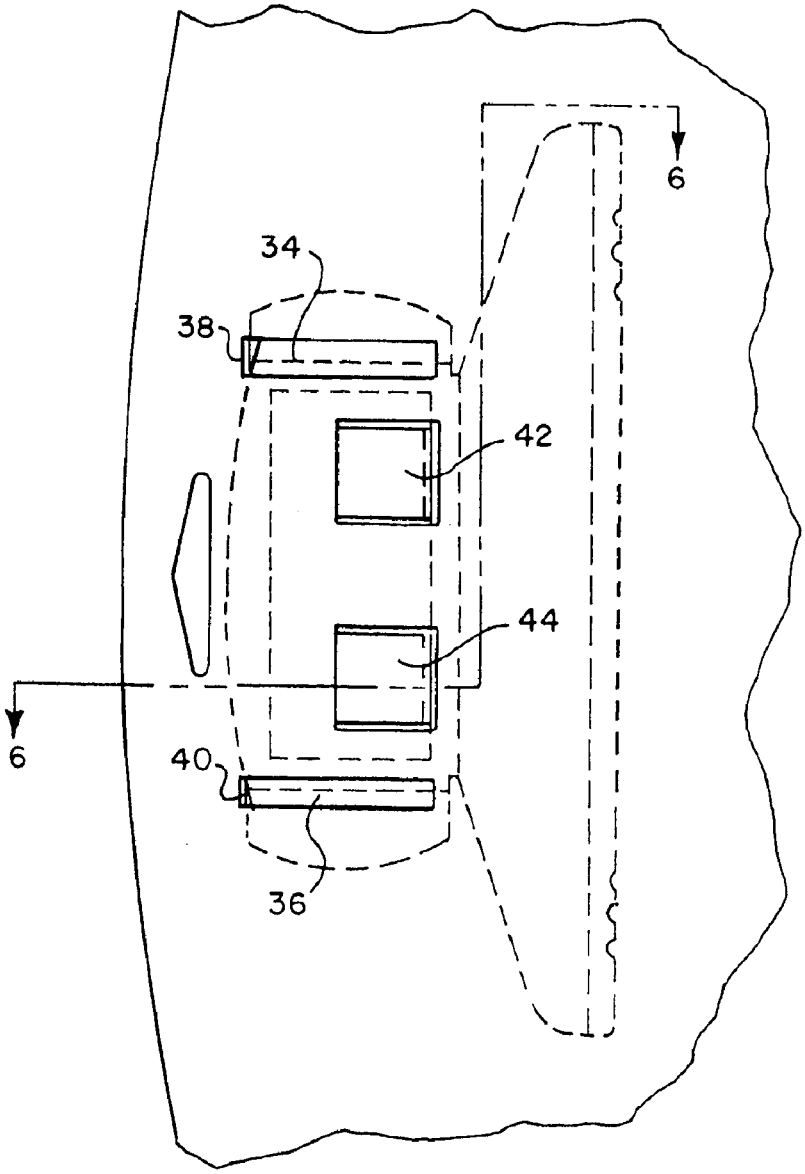
FIG. 4 is a bottom view of the clip mounted to the board.

Referring to FIGS. 1–6, where like numerals indicate like and corresponding elements, clipboard 10 includes a clip 12 and a board 14. Clip 12 has an upper part 16 and a lower part 18 integrally formed of thermoplastic and joined by a relatively-thin, living hinge 20.

A spring 22 formed of metal bent into a U-shape has an upper edge 24 engaged with the upper part 16 of the clip 12 and a lower edge 26 engaged with the lower part 18 of the clip 12. Spring retainers 28, 30 are molded into the clip upper and lower parts 16, 18, respectively, and engaged with the spring upper and lower edges 24, 26, respectively.

A key feature of the invention is the manner in which the clip is fastened to the board. Lower part 18 includes a locking wall 32 and spaced-apart hold-down edges 34,36. The board 14 has permanently-attached grips 38,40 engaged with the hold-down edges 34,36 of the lower part 18 of the clip 12. Grips 38,40 may be molded into the board 14, if it is molded thermoplastic, or could be riveted to a conventional hard fiber board.

Grips 38,40 and hold-down edges 34,36 are parallel and dimensioned to close tolerances, such that the clip 12 is restrained for linear, tightly-contacting, sliding motion with respect to board 14 when the grips 38,40 are engaged with the hold-down edges 34,36.

Figure 5:
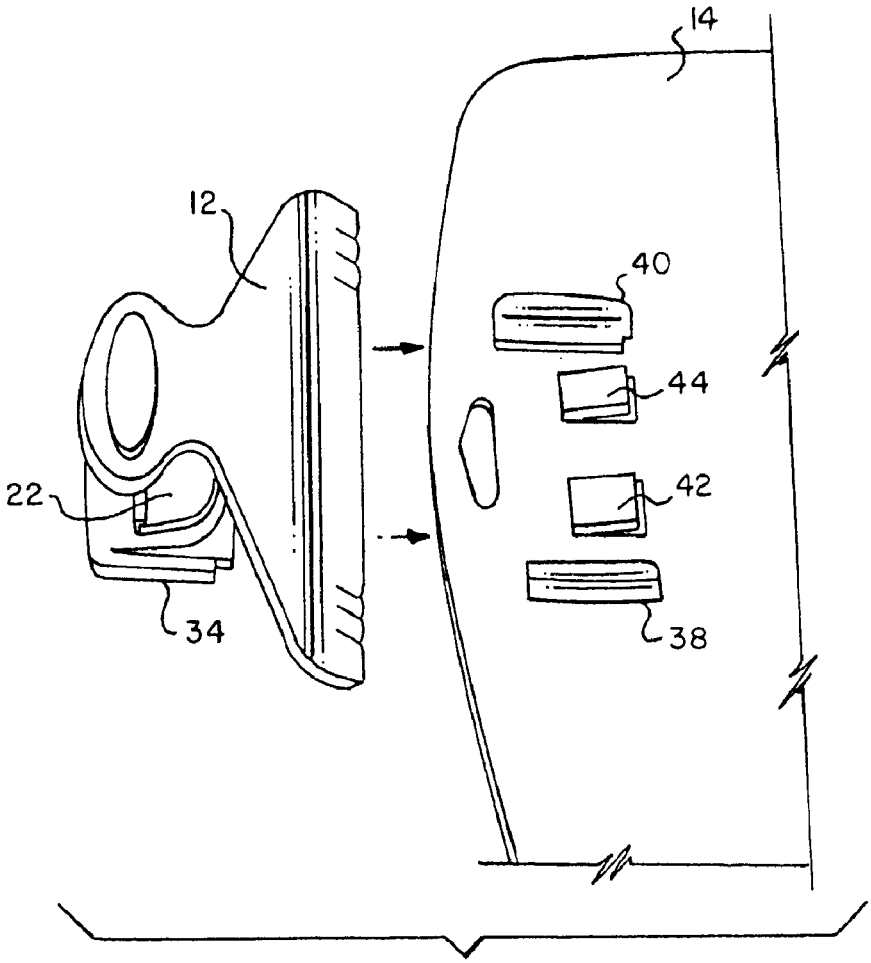
FIG. 5 is an exploded view of the clip and board.
Figure 6:
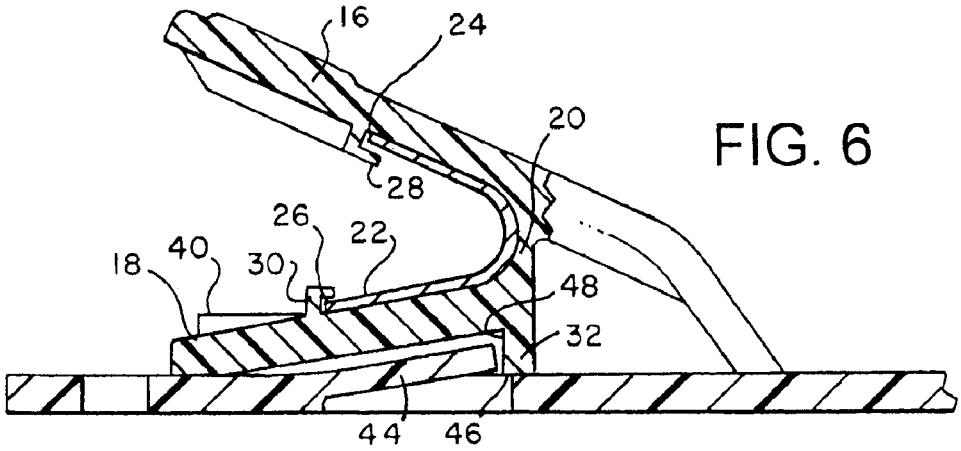
FIG. 6 is a sectional view taken along lines 6—6 of FIG. 4.

Board 14 has at least one, and preferably two, upstanding lock elements 42,44 engaged with the locking wall 32. Lock elements 42,44 are flexible and adapted and arranged to be moved into engagement with the locking wall 32 upon sliding motion of the clip 12 with respect to the board 14 as described above. Lock elements 42,44 are "upstanding" in the sense that upper portions of them stand above the plane of board 14 in their normal, unloaded state, as shown in FIG. 5. Lock elements 42,44 are generally planar elements having planar top surfaces at a relatively slight angle with respect to the plane of board 14, as shown in FIG. 6.

The locking wall 32 has a bottom surface 46 and a back surface 48. Bottom surface 46 of the locking wall 32 is adapted and arranged to depress the lock elements 42,44 upon sliding motion of the clip 12 with respect to the board 14, until the bottom surface 46 of the locking wall 32 clears the lock elements 42,44, whereupon the lock elements 42,44 stand back up to engage the back surface 48 of the locking wall 32 as shown in FIG. 6.

In operation, the clipboard of the present invention is easily manufactured, having only three parts in the preferred embodiment: the clip 12, the board 14, and the spring 22. The spring 22 easily snaps into place in clip 12. Clip 12 and board 14 are molded from thermoplastic, with the grips, hold-down edges and locking features all molded into the pieces. They are then easily assembled together in one quick sliding motion, using the combination of grips, hold-down edges, locking wall and lock elements. Assembly thus is not only quick but requires no tools. The assembly is essentially irreversible, although with sufficient determination the lock elements can be disengaged by slipping a thin object like a knife under the clip.

It will be understood that each of the elements described above, or two or more together, may also find a useful application in other types of constructions differing from the type described above.

While the invention has been illustrated and described as embodied in a preferred clipboard, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

Whereas, the present invention has been described with respect to a specific embodiment thereof, it will be understood that various changes and modifications will be suggested to one skilled in the art and it is intended to encompass such changes and modifications as fall within the scope of the appended claims.

What is claimed as new and desired to be protected by Letters Patent is set forth in the appended claims.

I claim:

1. A clipboard, comprising:

a clip having upper and lower parts joined by a living hinge;

the lower part of the clip including a locking wall;

the lower part of the clip including spaced-apart hold-down edges;

a board;

the board having at least one upstanding lock element engaged with the locking wall on the lower part of the clip; and the board including grips engaged with the hold-down edges of the lower part of the clip; and with the upper and lower parts of the clip and the hinge being integrally formed of thermoplastic.

2. The clipboard of claim 1 with a spring formed of metal bent into a U-shape with an upper edge engaged with the upper part of the clip and a lower edge engaged with the lower part of the clip.

3. The clipboard of claim 2 with the clip having upper and lower parts integrally formed of thermoplastic and joined by a living hinge, and spring retainers molded into the clip upper and lower parts engaged with the spring upper and lower edges, respectively.

4. The clipboard of claim 1 with the grips and hold-down edges being parallel;

with the clip being restrained for linear, sliding motion with respect to the board when the grips are engaged with the hold-down edges;

with the lock element being flexible, and lock element adapted and arranged to be moved into engagement with the locking wall upon sliding motion of the clip with respect to the board; and with the locking wall having a bottom surface and a back surface, the bottom surface of the locking wall being adapted and arranged to depress the lock element upon sliding motion of the clip with respect to the board, until the bottom surface of the locking wall clears the lock element, whereupon the lock element stands up to engage the back surface of the locking wall.

5. A clipboard, comprising:

a clip having upper and lower parts integrally formed of thermoplastic and joined by a living hinge;

a spring formed of metal bent into a U-shape with an upper edge engaged with the upper part of the clip and a lower edge engaged with the lower part of the clip;

spring retainers molded into the clip upper and lower parts engaged with the spring upper and lower edges, respectively;

the lower part including a locking wall;

the lower part including spaced-apart hold-down edges;

a board including grips engaged with the hold-down edges of the lower part of the clip;

the grips and hold-down edges being parallel, with the clip being restrained for linear, sliding motion with respect to the board when the grips are engaged with the hold-down edges;

the board having at least one upstanding lock element engaged with the locking wall;

the lock element being flexible and adapted and arranged to be moved into engagement with the locking wall upon sliding motion of the clip with respect to the board; and the locking wall having a bottom surface and a back surface, the bottom surface of the locking wall being adapted and arranged to depress the lock element upon sliding motion of the clip with respect to the board, until the bottom surface of the locking wall clears the lock element, whereupon the locking finger stands up to engage the back surface of the locking wall.

6. The clipboard of claim 5 with a plurality of lock elements, with the board being molded of thermoplastic, and the lock elements and grips being molded into the board.

* * * * *